US008998737B2

(12) United States Patent
Reid

(10) Patent No.: US 8,998,737 B2
(45) Date of Patent: Apr. 7, 2015

(54) GOLF SYSTEM

(75) Inventor: Martin Reid, Worcester (GB)

(73) Assignee: Black Hole Golf Ltd, Birmingham (GB)

( * ) Notice: Subject to any disclaimer, the term of this patent is extended or adjusted under 35 U.S.C. 154(b) by 918 days.

(21) Appl. No.: 12/480,436

(22) Filed: Jun. 8, 2009

(65) Prior Publication Data

US 2009/0305803 A1 Dec. 10, 2009

(30) Foreign Application Priority Data

Jun. 7, 2008 (GB) ..... 0810457.2

(51) Int. Cl.

| | |
|---|---|
| ***A63F 9/24*** | (2006.01) |
| ***A63B 24/00*** | (2006.01) |
| ***A63B 57/00*** | (2006.01) |
| ***A63B 69/36*** | (2006.01) |
| ***A63B 71/06*** | (2006.01) |
| *A63B 71/02* | (2006.01) |

(52) U.S. Cl.

CPC ..... *A63B 24/0003* (2013.01); *A63B 24/0021* (2013.01); *A63B 57/0056* (2013.01); *A63B 57/0081* (2013.01); *A63B 69/36* (2013.01); *A63B 71/028* (2013.01); *A63B 71/0622* (2013.01); *A63B 2024/0031* (2013.01); *A63B 2024/0037* (2013.01); *A63B 2071/0647* (2013.01); *A63B 2220/20* (2013.01); *A63B 2220/806* (2013.01); *A63B 2220/807* (2013.01); *A63B 2220/808* (2013.01); *A63B 2225/50* (2013.01)

(58) Field of Classification Search

None

See application file for complete search history.

(56) References Cited

U.S. PATENT DOCUMENTS

| | | | | |
|---|---|---|---|---|
| 4,652,998 | A * | 3/1987 | Koza et al. | 463/26 |
| 5,884,913 | A * | 3/1999 | Cohen | 473/154 |
| 6,741,250 | B1 * | 5/2004 | Furlan et al. | 345/427 |
| 2003/0004005 | A1 | 1/2003 | Ainsworth | |
| 2003/0096659 | A1 * | 5/2003 | Webb | 473/174 |

(Continued)

FOREIGN PATENT DOCUMENTS

| | | |
|---|---|---|
| GB | 2169211 | 7/1986 |
| GB | 2460753 | 1/2013 |
| JP | 2007050102 | 3/2007 |
| JP | 2008167245 | 7/2008 |
| WO | 0004961 | 2/2000 |
| WO | 2008068499 | 6/2008 |

OTHER PUBLICATIONS

UK Search Report dated Oct. 8, 2009.

(Continued)

*Primary Examiner* — Paul A D'Agostino

(74) *Attorney, Agent, or Firm* — Troutman Sanders LLP; James E. Schutz; Benjamin C. Wiles

(57) ABSTRACT

A golf shot recordal system permits images of a golfer's shot to be recorded. The system comprises a tee unit adjacent to the tee comprising a tee camera and a green unit in the golf hole on the green comprising a green camera. The tee unit further comprises a radio frequency video receiver to receive and decode signals corresponding to the image from the green camera and a video encoder to receive signals corresponding to the image from the tee camera and signals corresponding to the green images from the radio frequency receiver. The green unit further comprises a pin located in the golf hole, wherein the green camera is mounted on the pin, and a radio frequency video transmitter to send signals to the radio frequency video receiver in the tee unit. Also provided is a method of recording video images of a golfer's shot using the recordal system.

25 Claims, 3 Drawing Sheets

(56) References Cited

U.S. PATENT DOCUMENTS

| | | | | |
|---|---|---|---|---|
| 2004/0166948 | A1* | 8/2004 | Nelson | 473/151 |
| 2005/0192124 | A1* | 9/2005 | Tetens et al. | 473/405 |
| 2007/0099729 | A1* | 5/2007 | Green | 473/404 |
| 2007/0194858 | A1* | 8/2007 | Song et al. | 333/2 |
| 2007/0202951 | A1* | 8/2007 | Bogosian et al. | 463/42 |
| 2008/0049141 | A1* | 2/2008 | Fukui et al. | 348/565 |

OTHER PUBLICATIONS

Great Britain Search Report dated Nov. 29, 2011 for related British Application No. GB090806.2.
Great Britain Examination Report dated May 31, 2012 for related British Application No. GB090806.2.
Great Britain Examination Report dated Oct. 30, 2012 for related British Application No. GB090806.2.

* cited by examiner

GOLF SYSTEM

BACKGROUND

The present invention relates to a golf shot recordal system, which permits images of a golfer's shot to be recorded.

Golf is a game that is popular in many countries. Part of the enjoyment of the game for many golfers is discussing their good and bad shots after the round of golf has finished. However, as golf is typically played in groups of two to four people, only a small number of people will actually see the shot in question.

It would therefore be desirable for a golfer to be able to watch their shots back after the round has finished, so that they can share this with golfers who were not in their group when back in the clubhouse, or at a later time with friends or family who were not on the golf course. Watching the golfer's reaction to their shot may also provide entertainment.

This could also be useful for helping the golfer improve their game, as they can review their shots critically after their round of golf. They may also choose to show the shots to the club pro or other coach or trainer to obtain feedback on the shots.

The system could also be used to measure the length of a golfer's shot or to assess which golfer's ball is closest the hole from a group of golfers.

Systems exist for monitoring the golf swing of a golfer, e.g. in virtual reality golf games, but these do not record an overall golf shot.

A system for implementing a closest to the pin challenge is also known, as described in US2005/0192124. This system employs a tall lamppost-like structure located to one side of the green, housing a computer-controlled camera with pan, tilt and zoom control. The concept employs a laser tracking system for location of the ball on the green and uses complex mathematical algorithms to analyse the data and determine the absolute distance of each ball from the hole. There are a number of fundamental theoretical and practical challenges with this approach. These include the aesthetic and obstructive nature of such a large, permanent structure, the possible need for planning permission, the need for very long cables to be buried underground with the inherent disruption and damage to the course, inflexibility, difficulty of maintenance, the possible health and safety implications associated with using a tracking laser on the green where it could potentially cause retina damage to golfers, and susceptibility to vandalism and possible lightning damage.

Even if these practical issues could be overcome, the system is extremely complex and the inherent geometric limitations imposed by the offset camera position would require sophisticated calibration and processing of the data to compensate for the asymmetric configuration, with considerable potential for measurement inaccuracy, which could compromise the validity of the competition. It is considered that these factors would make it very difficult and extremely costly to realise a practical implementation of the concept.

Accordingly, there is a need for a system that permits images of a golfer's shot to be recorded whilst avoiding or alleviating such problems.

SUMMARY OF THE INVENTION

The present invention provides, in a first aspect, a golf shot recordal system that permits images of a golfer's shot to be recorded, which comprises:

(a) a tee unit that comprises a tee camera, which can provide a video image of the golfer and the golf ball at the tee, and down the fairway towards the green, the tee unit being locatable adjacent to the tee; and (b) a green unit that comprises a green camera, which can provide a video image of the golf ball when it has been hit onto the green, the green unit being locatable in the golf hole on the green;

wherein the tee unit further comprises:

(i) a radio frequency video receiver which can receive and decode signals corresponding to the image from the green camera; and (ii) a video encoder that can receive signals corresponding to the tee images from the tee camera and that can receive signals corresponding to the green images from the radio frequency receiver;

and wherein the green unit further comprises:

(1) a pin that can be securely located in the golf hole on the green, wherein the green camera is mounted on the pin; and (2) a radio frequency video transmitter which can send signals to the radio frequency video receiver in the tee unit.

When reference is made to the green unit being locatable in the golf hole on the green, the skilled man will of course appreciate that only some of the green unit need be located in the golf hole; the remainder of the unit may be proximate the hole.

The central axis of the field of vision of the green camera is preferably substantially directly in line with the pin.

In use it is envisaged that the tee unit will be located behind the tee area, i.e. such that the tee area is between the tee unit and the fairway. The tee camera will obtain a view of the golfer at the tee, and beyond down the fairway to the green. The green camera will obtain a view of the ball once it has been hit onto the green. This is sent by the radio frequency video transmitter to the radio frequency video receiver, which will decode the image. The camera signals from both the tee camera and the green camera will be fed to the video encoder.

The tee camera may obtain images of the golfer not only as the ball is hit on the tee but also after the shot has been hit, so as to record the reaction of the golfer.

Preferably, the video encoder will compress the green camera image and insert it as an inset in the image from the tee camera, e.g. into the top left or right quadrant of the image from the tee camera, as appropriate depending on whether the green in to the left or the right of the tee location for the particular hole.

The video image may be watched on a screen at the tee, or may be transmitted to the club house where it may be watched on a screen there. It may also be saved to a storage device such as a USB storage device, and/or uploaded to the internet.

The tee camera may be any camera that can provide a view of the golfer and the golf ball on the tee. It may, for example, be a high-resolution standard-definition colour model with a lens providing a fixed field of view.

The video encoder is suitably a digital video encoder. This may, for example, be a digital video encoder that has been modified or custom-designed to provide a main image from the tee camera, and to insert a digitally compressed version of the image from the green camera into this image, e.g. in an upper quadrant thereof.

As the skilled man will appreciate, picture-in-picture video encoders are known, for example they may be provided in TVs, security systems etc. In particular, they have been used for CCTV monitoring. Therefore the provision of a picture-in-picture digital video encoder is readily achievable.

The radio frequency video encoder is suitably an analogue radio frequency video receiver. The radio frequency video encoder suitably will operate in the UHF band.

The tee unit may further comprise a microphone. In this case, the image from the video encoder may be combined with audio from the microphone. Ambient audio can therefore be picked up and recorded to provide a meaningful soundtrack to the images.

The image, or the combined image and audio, may be fed to an integral digital video recorder or to a microwave transmitter and may then be relayed onwards to a viewing location, e.g. in the club house.

The tee unit may comprise an input device to enable each golfer to identify themselves before taking their shot. For example, the input device may comprise a keypad, touch screen, card reader, fingerprint recognition unit, iris recognition unit or voice recognition unit.

The tee unit suitably comprises a system control unit which activates one or more of the various components of the tee unit, e.g. the camera or the video encoder or the radio frequency video receiver. It may optionally also control one or more of the various components of the green unit via a radio frequency link, e.g. the camera or the radio frequency video transmitter.

The input unit may be used to initiate the activation of one or more of the components via the system control unit.

The use of an input device in combination with a system control unit allows power to be saved as the components can then be in an off/power save condition normally and be turned on only when a golfer approaches the tee and uses the input device to identify themselves.

The tee unit and the green unit are preferably connected by bi-directional radio frequency links. Accordingly, it is preferred that the tee unit comprises a radio frequency control data transmitter unit and the green unit comprises a corresponding radio frequency data receiver unit, wherein the radio frequency data receiver unit in the green unit can receive data from, and send analogue video data to, the radio frequency data transmitter unit in the tee unit.

The image recording of the image from the green camera may be started using a time delay system whereby recording begins a set period of time after the input unit has been used by the golfer.

Alternatively or additionally, the system may include a sensor to detect the instant at which the ball is struck and to trigger the start of the recording from that point. The sensor may be an audio sensor, for example it may comprise a microphone, such as a rifle microphone, and an audio processor.

For example, the system may include both a time delay and a sensor system and the recording is then triggered by whichever of these occurs earlier.

Preferably, the tee unit and the green unit are connected by bi-directional radio frequency links as discussed above and the image recording from the green camera may, therefore, be started via a radio frequency signal from the tee unit following the time delay and/or sensor signal.

The tee unit may preferably be self powered, that is to say that in use it does not need to be directly attached to a separate power source such as the mains electricity or a generator. The unit may be powered by any system that allows self powering. For example, the unit may be battery charged, preferably by rechargeable batteries. In this case the unit may be taken indoors each evening and recharged overnight. The unit may alternatively or additionally be solar powered.

The advantage of the tee unit being self-powered is that this avoids the need for the installation of long outdoor mains power cables around the course, with all the practical, aesthetic, safety, maintenance and cost implications that would be involved.

The tee unit may, therefore, in a preferred embodiment exhibit the advantage of intelligent operation. Specifically, the features of:

- an input device (e.g. a keypad/card reader system) for the identification of each golfer,
- a sensor system to detect the moment that the ball is struck, or a timer system to initiate the recording sequence over a set time, and
- a system control unit for operation of the cameras, video encoder and the transmitters/receivers, allow automatic unattended operation of the entire system and enable a precisely controlled video recording to be made of the swing, flight and landing of the ball and the reaction of the golfer. Preferably the use of a microphone provides audio as well as visual recording.

By integrating the images from the tee camera and the green camera using real-time picture-in-picture encoding, the need for time consuming editing of the video images is avoided. This also means that the possibility of a competitor cheating is virtually eliminated, as the whole sequence is recorded in real time and as a composite image that avoids tampering risk.

The tee unit is preferably portable, in particular readily transportable; in a preferred embodiment it is designed to fit onto the back of a standard golf cart. This allows it to readily be taken into storage overnight, providing security against theft or damage, as well as permitting recharging to occur. The overall shape of the enclosure will be designed with both functionality and transportability in mind, and the individual components, particularly the batteries, selected to minimise the weight.

This portability also means that the system can be used on any hole on any course without significant modification or groundwork, with no permanent or visible alterations.

Preferably the green camera is a camera or camera system that can record images from all angles surrounding the flag. For example, it may be a camera with a fisheye lens, or it may be a camera system comprising four or more cameras, such as a four, five or six camera system.

Preferably the green camera has a fisheye lens. The advantage of a fish eye lens is that it can record a good quality video output and a high resolution still image to be used for analysis, whilst also being able to record images from all angles surrounding the flag.

In an alternative embodiment, a four camera system may be used. A four camera system may increase the potential resolution of the image whilst recording images from all angles surrounding the flag.

The use of camera systems with more than four cameras is also possible but may present further complication in the encoding process.

The green camera provides composite video output to the radio frequency video receiver. This can therefore provide standard definition real-time video for inclusion in a composite picture-in-picture image produced by the video encoder of the tee unit.

In one embodiment the green camera is a high-resolution stills camera with a fisheye lens. High-resolution still images may therefore also be recorded to enable the distance of the ball from the hole to be accurately determined at the end of the game. In particular, a high-resolution still image of the whole green area may be recorded, for subsequent analysis of the distance of the ball from the pin.

The green camera is preferably housed inside a first housing mounted on the pin. The housing must clearly allow the camera to view the ball on the green. Therefore in the areas of the housing that the camera needs to see through to be able to see the ball on the green the housing may comprise windows or may be transparent. Preferably, substantially all or all of the housing is transparent.

Preferably, the housing is a hemispherical dome. Other shapes that permit the camera to adequately view the green may, however, also be considered.

The central axis of the field of vision of the camera is directly in line with the pin and therefore the centre of the hole. If the camera has a single lens, e.g. when the camera is a fisheye lens camera, the central axis of the camera lens is directly in line with the pin and therefore the centre of the hole. If the camera has multiple lenses, e.g. when the camera is a hour camera system, the central axis of the lenses is directly in line with the pin and therefore the centre of the hole. Ideal optical geometry is achieved by mounting the axis of the lens directly in line with the centre of the hole. The need for complex mathematical analysis of the images is eliminated.

There is a very high degree of relative accuracy in this design, eliminating any potential calibration and calculation errors. The inherent non-linearity produced by a fisheye lens further enhances the relative distance resolution.

This innovative design for the camera housing, based on a transparent hemispherical dome to which the pin is attached in line with the central axis of the lens, enables the ideal optical geometry to be achieved.

The dome design also minimizes the likelihood of raindrops coming to rest on the dome and interfering with the image quality. The outside surface of the dome may also be treated with water repellent to prevent static water drops from forming and thus distorting the image.

Suitably the housing is made from plastics materials.

The other components of the green unit may be housed inside a second housing mounted on the pin. For example, the second housing may be a cylindrical enclosure. Other shapes that permit the other components to be stored may, however, also be considered.

The second housing will suitably incorporate the radio frequency video transmitter. For example, it may incorporate a UHF analogue video transmitter and antenna to relay the video signal from the green camera to the tee unit.

The second housing may suitably be mounted above the first housing so that it does not obstruct the camera view of the green.

The pin may be of dimensions and materials as commonly used for a golf pin.

The pin is suitably provided with a flag, as is conventional in golf. This may be mounted on the pin above the first housing; for example it may be mounted on the pin above the first and second housings.

The green unit may further comprise a system control unit, which controls one or more of the various components of the green unit, e.g. the camera or the radio frequency video transmitter.

In one embodiment, when the system control unit in the tee unit is activated, the system control unit in the green unit will receive a radio frequency signal which will in turn cause activation of the camera and video transmitter.

Accordingly, power-saving features may be incorporated into the design. The use of a system control unit allows power to be saved as the components can then be in an off position normally and be turned on only when the control unit activates the camera and video transmitter.

The recording at the green camera may be started using a time delay system. For example, recording may begin a set period of time after the ball has been struck, or a set period from activation of the system control unit in the green unit, or at whichever is the earlier of these two periods of time.

Preferably, the unit will return to standby mode after recording the ball on the green.

By automating the operational sequence, power consumption is minimised.

The green unit may preferably be self powered, that is to say that in use it does not need to be directly attached to a separate power source such as the mains electricity or a generator. The unit may be powered by any system that allows self powering. For example, the unit may be battery powered, preferably by rechargeable batteries. In this case the unit may be taken indoors each evening and recharged overnight. The unit may alternatively or additionally be solar powered.

In one embodiment the green unit uses rechargeable batteries, supplemented by solar panels on the top surface enabling recharging of the batteries to supplement the available power and thereby keeping the weight and size to a minimum. It is designed to be taken indoors each evening and recharged overnight.

The advantage of the green unit being self-powered is that this avoids the need for the installation of long outdoor mains power cables around the course, with all the practical, aesthetic, safety, maintenance and cost implications that would be involved.

The green unit should be robust enough to withstand a degree of rough handling but light enough to be lifted from the hole. It should also withstand a range of adverse climatic conditions. This may be achieved by one or more of the following: using a heavy duty transparent polycarbonate or similar material for the housing; using lightweight components; providing internal anti-shock mountings for the camera and other sensitive components.

In one embodiment the system further includes a hole unit which can be inserted into a standard golf hole, optionally with some minimal modification, fitting securely therein. A special tool may be designed for this. The hole unit and the pin are shaped so that the pin can be releasably secured in the hole unit.

Preferably, the pin and the hole unit have corresponding mechanical self-aligning features that will ensure that the height and orientation of the pin, and hence the height and orientation of the camera mounted on the pin, is consistently maintained each time the pin is removed and reinserted.

For example, the pin and the hole unit may be provided with an offset spigot and corresponding helical guide and alignment channel so that the pin can be releasably secured in the hole unit at a consistent height and angular orientation.

Specifically, this may be achieved by using a pin, preferably a metallic pin, provided with a precision engineered offset spigot at or near its distal end, and with a corresponding helical guide and alignment channel being provided in the hole unit. When the pin is placed in the hole unit, the spigot will cause the pin to rotate to the correct angular alignment as it is lowered into place. The pin may optionally be threaded towards its proximal end to facilitate attachment to the or each housing.

It is envisaged that the pin will be precision engineered to ensure rigidity and accurate alignment when the pin is replaced in the hole.

Provision may also be made for drainage of the hole unit. This may be achieved by providing drainage holes, for example within the portion of the hole unit for receipt of the pin, so that any water is displaced when the pin is inserted.

Once installed, the hole unit is designed to be virtually maintenance-free, and to replicate a standard hole in all key features with respect to critical dimensions and surface resilience.

The system may further comprise a club house unit for replaying and/or analysing the recordings. This may comprise: a computer running suitably programmed software; a dedicated hardware and software based system; or a combination thereof.

The club house unit and the tee unit may be connected via a unidirectional microwave video link, allowing live video from the cameras to be recorded in real time and relayed to screens in the club house.

The club house unit may receive a combined video signal comprising a composite picture-in-picture video stream from the tee unit, transmitted whenever the camera system is activated. Preferably, it will also include an ambient audio signal.

The club house unit may suitably record the incoming signals. This then allows for golfers to watch their recorded shots once they have completed their round and have returned to the club house.

Accordingly, the club house unit may suitably receive and record a real time video (and optionally audio) stream from the tee unit while at the same time playing back earlier recordings for viewing on screens/displays in the club house, enabling those who have completed their rounds to watch their own and others' performances.

In an alternative embodiment, recordings of the video sand optionally audio) stream may be made in the tee unit. These recordings can then be physically transferred to the club house unit using any known data storage device; for example they may be transferred using a portable USB device or a DVD.

The club house unit may also be used to carry out analysis of high resolution still images from the green camera. Absolute distances may be calculated via such a calibrated replay system.

This analysis may be a semi-automated process carried out by a suitably trained operator. For example, an operator may initially review each image to produce a shortlist of those shots within a defined group that fall within a certain distance of the hole, and then analyse these using a suitable computer and software to determine the closest shot within the defined group. For example, a precision calibrated overlay may be used to assist in determining the closest shot to the hole. The defined group may be, for example, those who have entered a competition, or those who belong to a certain club or have a specified age or golf handicap, or belong to a particular group of members, or it may be those who played within a certain time frame, for example during the course of a certain day.

In one embodiment, the club house unit may further include the facility to upload the video streams for internet access, allowing golfers to review their shots after the event, for example with family and friends.

The invention also provides, in a second aspect, a golf hole including a tee, a fairway and a green provided with a hole, wherein the golf hole further comprises a golf shot recordal system in accordance with the first aspect, wherein the tee unit of the system is located at or near the tee of the golf hole, and the green unit of the system is located in the hole on the green.

The invention also provides, in a third aspect, a method of recording video images of a golfer's shot, the method comprising:

A. providing a golf shot recordal system in accordance with the first aspect;

B. recording a video image of the golfer striking the ball on the tee using the tee camera; and C. recording a video image of the ball on the green using the green camera.

In one embodiment, the image obtained in step B and the image obtained in step C are combined to produce a video image where the image of the ball on the green is inset into the image of the golfer on the tee.

DETAILED DESCRIPTION

Before explaining the preferred embodiment in detail, it should be noted that the invention is not limited in its application or use to the details of construction and arrangement of parts illustrated in the accompanying drawings and description, because the illustrative embodiment of the invention may be implemented or incorporated in other embodiments, variations and modifications, and may be practiced or carried out in various ways. Furthermore, unless otherwise indicated, the terms and expressions employed herein have been chosen for the purpose of describing the preferred embodiment of the present invention for the convenience of the reader and are not for the purpose of limitation.

Figure 1:
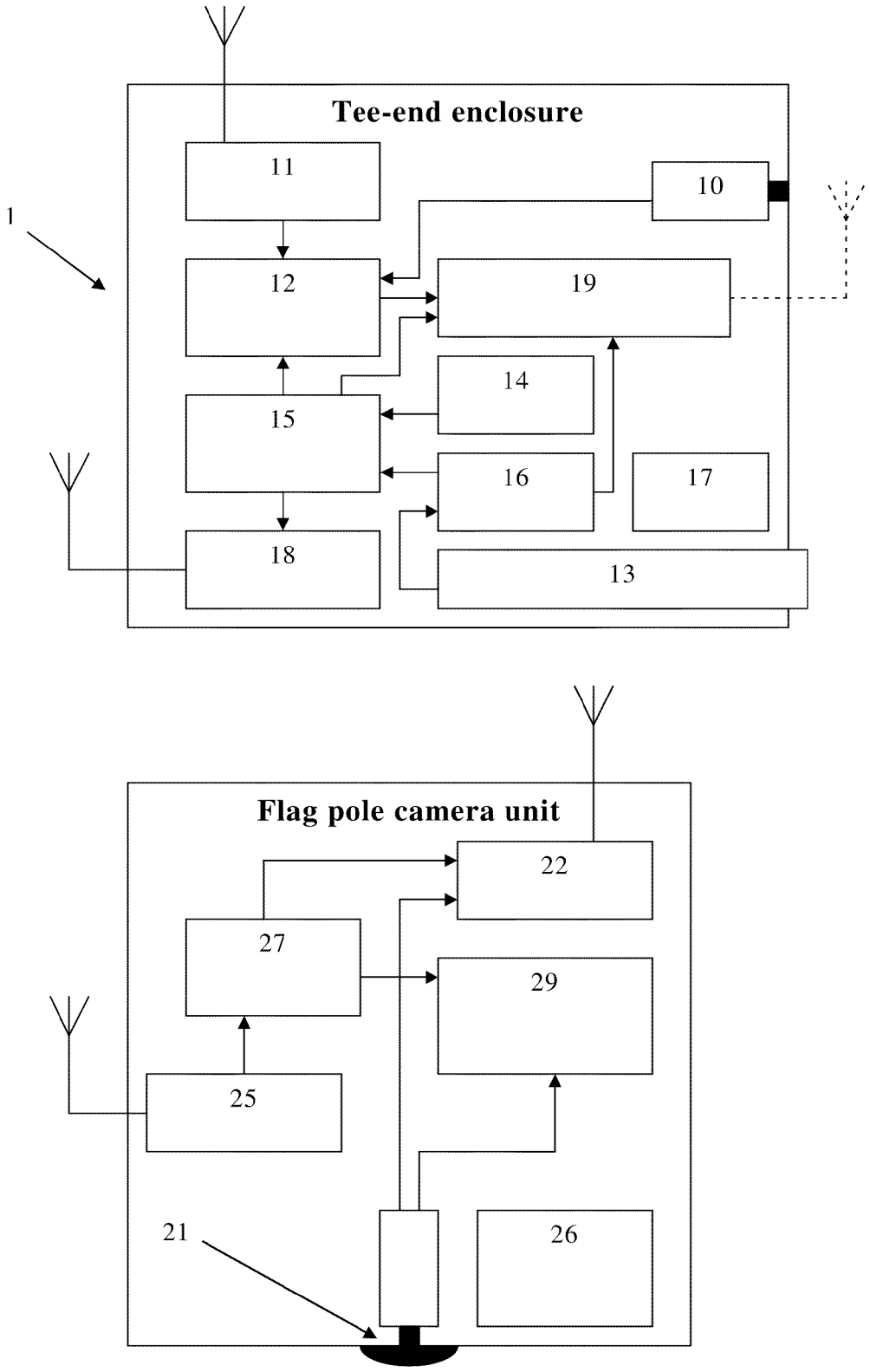
FIG. 1 is a conceptual block diagram showing a golf shot recordal system in accordance with the invention.
Figure 2:
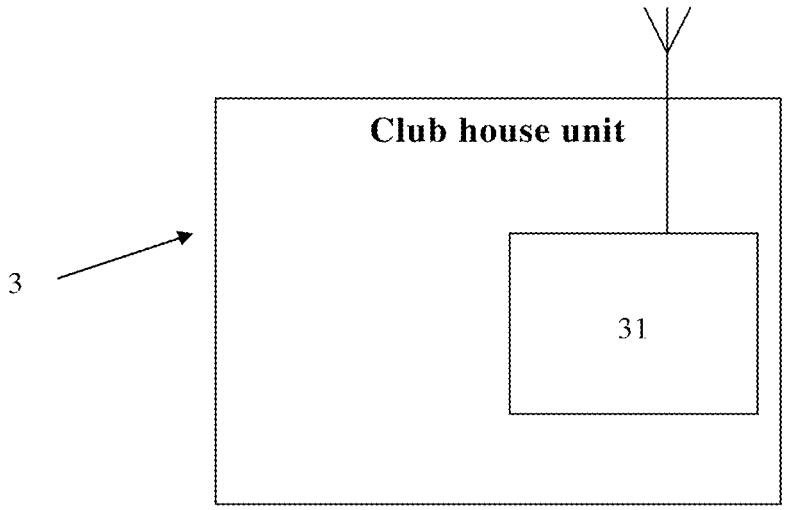
FIG. 2 is a conceptual block diagram showing the club house unit that may optionally be used in the system according to the invention.
Figure 3A:
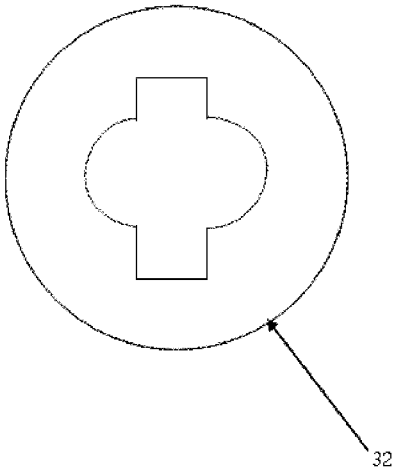
FIG. 3*a* is a diagram from above showing the hole unit that may optionally be used in the system according to the invention.
Figure 3B:
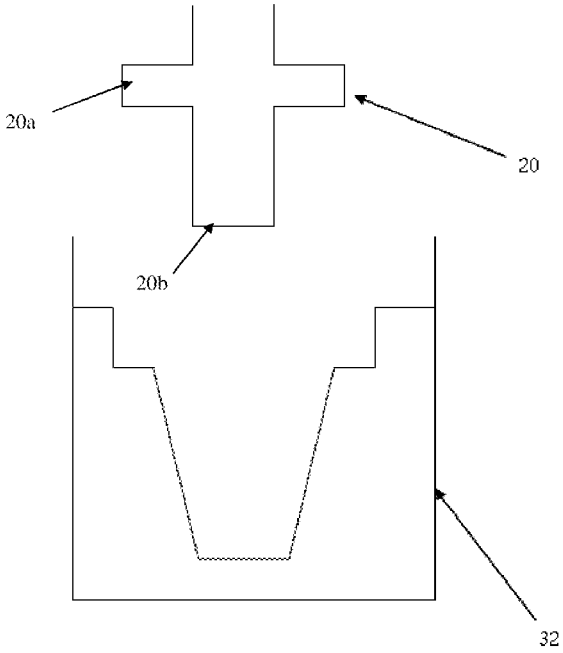
FIG. 3*b* is a side view diagram showing the hole unit of FIG. 3*a*, together with the pin.
Figure 4:
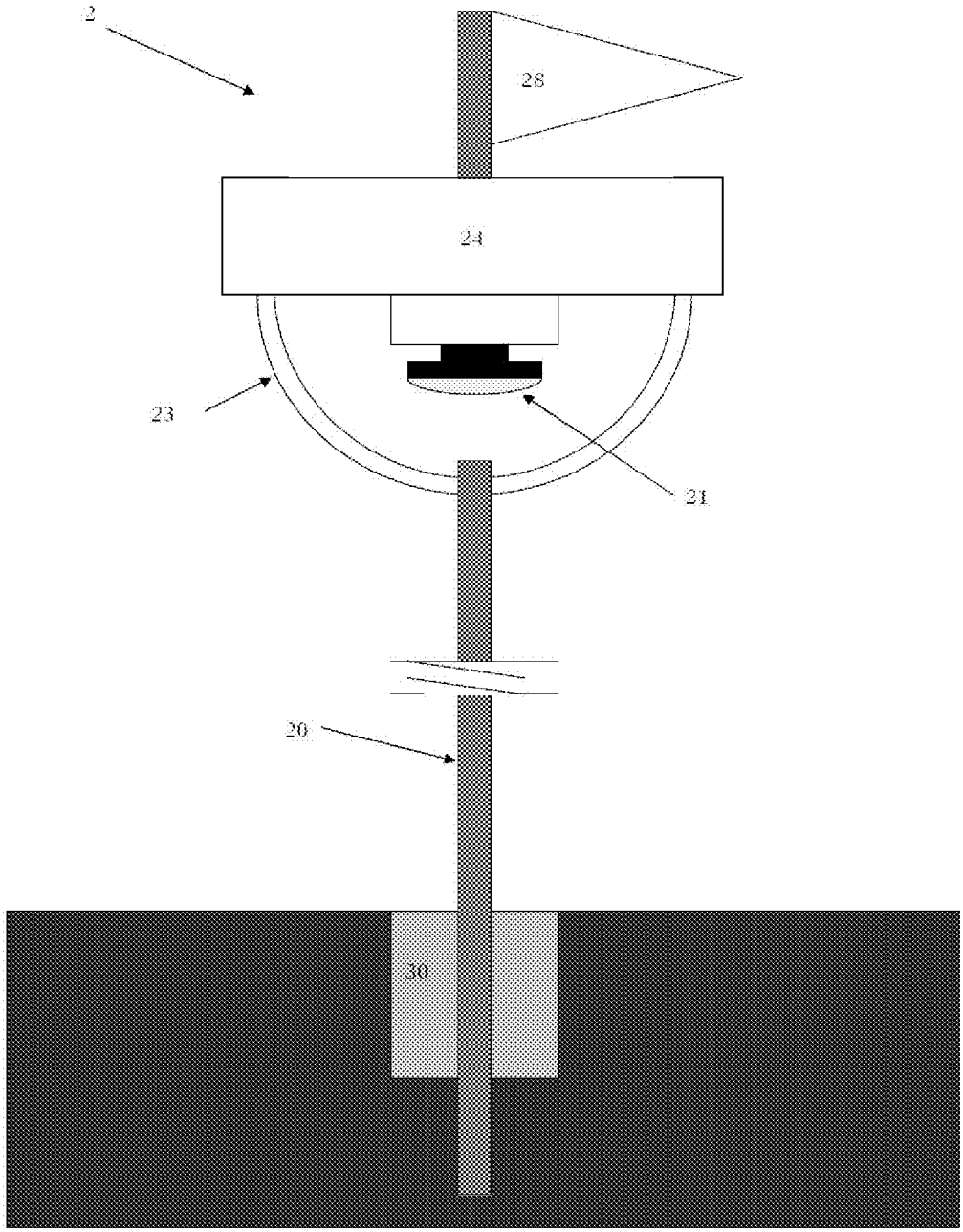
FIG. 4 is a diagram showing the green unit of the shot recordal system of FIG. 1.

FIGS. 1 to 4 show a golf shot recordal system in accordance with the invention, which permits video images of a golfer's shot to be recorded.

The system comprises a tee unit 1 that is locatable adjacent to the tee and that is capable of recording video images of the golfer and the golf ball when they are on the tee, and a green unit 2 that is locatable in the golf hole on the green and that is capable of recording video images of the golf ball when it is on the green.

The tee unit is provided with a tee camera 10 that can provide a video image of the golfer at the tee, and down the fairway towards the green. It also includes a radio frequency video receiver 11, and a video encoder 12, a microphone 13, an input device 14, a system control unit 15, an audio processor 16, batteries 17, radio frequency control data link 18, and microwave transmitter 19.

The green unit comprises a pin 20 that can be securely located in the golf hole on the green. A green camera 21, which can provide a video image of the golf ball when it has been hit onto the green, is mounted on the pin. The green unit also includes a radio frequency video transmitter 22, a first housing 23, a second housing 24, radio frequency control data link 25, batteries 26, system control unit 27, flag 28, and high resolution digital still image storage unit 29.

The radio frequency video receiver 11 receives and decodes signals corresponding to the image from the green camera, which have been sent from the radio frequency video transmitter 22.

The video encoder 12 receives signals corresponding to the tee images from the tee camera 10 and receives signals corresponding to the green images from the radio frequency receiver 11.

The tee unit and the green unit are connected by bi-directional radio frequency links. In this regard, the radio frequency control data link 18 can receive data from and send data to the radio frequency control data link 25.

The input device 14 enables each golfer to identify themselves before taking their shot. In one embodiment, the input device may comprise a keypad or card reader.

The system control unit 15 activates the camera 10, the video encoder 12 and the radio frequency receiver 11. It also sends a signal to the system control unit 27. The system control unit 15 is itself activated by a successful input at the input unit 14.

The audio processor 16 and the microphone 13 together act as an audio sensor to detect the instant at which the ball is struck. This triggers the start of the video recording from the green camera from that point. In this regard, a radio frequency signal is sent from radio frequency control data link 18 in the tee unit to the radio frequency control data link 25 in the green unit.

The tee unit is powered by rechargeable batteries 17.

The microwave transmitter 19 can transmit the video images from the video encoder 12, and optionally audio from the microphone 13, to a separate location, such as the club house.

In one embodiment, a club house unit 3 is used in the system. This includes a video unit 31 that receives a combined video signal, comprising a composite picture-in-picture video stream received from the tee unit, via the microwave transmitter 19. This signal is transmitted whenever the camera system is activated. The video unit 31 not only receives the signal but can also be used for replaying and/or analysing the recordings.

The green camera 21 is a high-resolution stills camera with a fisheye lens that can provide a video image of the ball when it has been hit onto the green. High-resolution still images may therefore also be recorded to enable the distance of the ball from the hole to be accurately determined at the end of the game.

High-resolution still images are stored on high resolution digital still image storage unit 29.

The radio frequency video transmitter 22 sends signals from the green camera 21 to the radio frequency video receiver 11 in the tee unit.

The green camera 21 is housed inside the first housing 23 which is mounted on the pin 20. The housing 23 is transparent and is in the shape of a hemispherical dome. The outside surface of the housing 23 is treated with water repellent to prevent static water drops from forming.

The central axis of the camera lens is directly in line with the pin 20 and therefore the centre of the hole 30.

A hole unit 32 may optionally be used to securely locate the pin 20 in the golf hole 30. The hole unit is shaped such that it can be inserted into the golf hole 30. The hole unit and the pin are shaped so that the pin can be releasably secured in the hole unit.

The pin 20 is provided with an offset spigot 20*a* at or near the distal end 20*b* of the pin and the hole unit 32 is provided with a corresponding alignment channel, so that the pin can be releasably secured in the hole unit at a consistent height and angular orientation.

The radio frequency video transmitter 22, radio frequency control data link 25, batteries 26, system control unit 27, and high resolution digital still image storage unit 29 are housed inside the second housing 24 mounted on the pin 20. The second housing is a circular enclosure and is mounted above the first housing 23 so that it does not obstruct the camera view of the green.

The pin 20 is provided with a flag 28, which is mounted on the pin above the first and second housings 23, 24.

The system control unit 27 controls the camera 21 and the radio frequency video transmitter 22. When the system control unit 15 in the tee unit is activated, the system control unit 27 in the green unit will receive a radio frequency signal via the radio frequency control data links 18, 25, which will in turn cause activation of the camera 21 and video transmitter 22.

The green unit is powered by rechargeable batteries 26, supplemented by solar panels on the top surface enabling recharging of the batteries to supplement the available power and thereby keeping the weight and size to a minimum.

In use, the tee unit will be located behind the tee area, i.e. such that the tee area is between the tee unit and the fairway. The tee camera 10 will obtain a view of the golfer at the tee, and beyond down the fairway to the green.

Meanwhile, the green camera 21, located on the pin 20 in the hole 30, will obtain a view of the ball once it has been hit onto the green. The radio frequency video transmitter 22 will transmit the image to the radio frequency video receiver 11, which will decode the image.

The camera signals from both the tee camera 10 and the radio frequency video receiver 11 (relating to the images from the green camera 21) will be fed to the video encoder 12. The video encoder will compress the green camera image and insert it as an inset in the top left or right quadrant of the image from the tee camera, as appropriate depending on whether the green in to the left or the right of the tee location for the particular hole.

This combined video image from the video encoder may be combined with audio from the microphone 13.

The video image may be watched on a screen at the tee, or may be transmitted to the club house where it may be watched on a screen there, e.g. via the video unit 31. It may also be saved to a storage device such as a USB storage device, and/or uploaded to the internet.

Although the present invention has been described in detail by way of illustration and example, it should be understood that a wide range of changes and modifications can be made to the preferred embodiments described above without departing in any way from the scope and spirit of the invention.

Thus, the described embodiments are to be considered in all respects only as illustrative and not restrictive, and the scope of the invention is, therefore, indicated by the appended claims rather than the foregoing description. All changes that come within the meaning and range of equivalency of the claims are to be embraced within their scope.

The invention claimed is:

1. A golf shot recordal system that permits images of a golfer's shot to be recorded, the system comprising:

(a) a tee unit that comprises a tee camera, which can provide a video image of the golfer and a golf ball at a tee, and down a fairway towards a green, the tee unit being locatable adjacent to the tee; and (b) a green unit that comprises a green camera, which can provide a video image of the golf ball when it has been hit onto the green, the green unit being locatable in a golf hole on the green;

the green unit further comprising a pin that can be securely located in the golf hole on the green, with the green camera being mounted on the pin and with a central axis of a field of vision of the green camera being substantially directly in line with the pin, such that a video image of the golf ball when it has been hit onto the green can be obtained;

the tee unit further comprising:

(i) a radio frequency video receiver which can receive and decode signals corresponding to the image from the green camera; and (ii) a video encoder that can receive signals corresponding to the tee images from the tee camera and that can receive signals corresponding to the green images from the radio frequency receiver;

and the green unit further comprising:

a radio frequency video transmitter which can send signals to the radio frequency video receiver in the tee unit;

wherein the tee unit can receive video images from the tee camera of the golfer and the golf ball at the tee, and down the fairway towards the green, and the tee unit can also receive video images from the green camera of the golf ball when it has been hit onto the green, meaning that a video image from the tee camera and a video image from the green camera can both be provided at the tee;

wherein the system further comprises one or both of: (a) a time delay system, such that image recording of the image from the green camera is started using said time delay system; and (b) a sensor to detect the instant at which the ball is struck and to trigger the image to start recording from that point; and wherein the recorded video images may be replayed, thereby allowing the golfer to be able to watch the golfer's shots after a round of golf has finished.

2. The system of claim 1, wherein the tee unit further comprises a microphone.

3. The system of claim 1, wherein the tee unit comprises an input device to enable each golfer to identify themselves before taking their shot.

4. The system of claim 1, wherein the tee unit comprises a system control unit which activates one or more of the camera or the video encoder or the radio frequency video receiver.

5. The system of claim 1, wherein the tee unit is powered by rechargeable batteries.

6. The system of claim 1, wherein the tee unit and the green unit are connected by bi-directional radio frequency links.

7. The system of claim 1, wherein the green camera has a fisheye lens.

8. The system of claim 7, wherein the green camera is a high-resolution stills camera with a fisheye lens.

9. The system of claim 1, wherein the green camera is housed inside a first housing mounted on the pin.

10. The system of claim 9, wherein the first housing is transparent.

11. The system of claim 9, wherein the first housing is a hemispherical dome shape.

12. The system of claim 1, wherein the green unit further comprises a system control unit, which controls one or more of the camera or the radio frequency video transmitter.

13. The system of claim 1, wherein the green unit is powered by rechargeable batteries, coupled to one or more solar panels.

14. The system of claim 1, wherein the system further includes a hole unit which can be inserted into a standard golf hole, fitting securely therein, with the hole unit and the pin being shaped so that the pin can be releasably secured in the hole unit.

15. The system of claim 14, wherein the pin and the hole unit have corresponding mechanical self-aligning features that will ensure that the height and orientation of the pin, and hence the height and orientation of the camera mounted on the pin, is consistently maintained each time the pin is removed and reinserted.

16. The system of claim 15, wherein the pin is provided with an offset spigot proximate its distal end, and the hole unit is provided with a corresponding helical guide and alignment channel.

17. The system of claim 1, wherein the system further comprises a club house unit for replaying and/or analysing the recordings.

18. The system of claim 17, wherein the club house unit receives a combined video signal comprising a composite picture-in-picture video stream from the tee unit, transmitted whenever the camera system is activated.

19. A golf hole system including a tee, a fairway and a green provided with a golf hole, which is a cup for receiving a golf ball, wherein the golf hole system further comprises a golf shot recordal system, said golf shot recordal system comprising:

(a) a tee unit that comprises a tee camera, which can provide a video image of a golfer and the golf ball at the tee and down the fairway towards the green, the tee unit being locatable adjacent to the tee; and (b) a green unit that comprises a green camera, which can provide a video image of the golf ball when it has been hit onto the green, the green unit being locatable proximate the golf hole on the green;

the green unit further comprising a pin that can be securely located in the golf hole on the green, with the green camera being mounted on the pin and with a central axis of a field of vision of the green camera being substantially directly in line with the pin, such that a video image of the golf ball when it has been hit onto the green can be obtained;

the tee unit further comprising:

(i) a radio frequency video receiver which can receive and decode signals corresponding to the image from the green camera; and (ii) a video encoder that can receive signals corresponding to the tee images from the tee camera and that can receive signals corresponding to the green images from the radio frequency receiver;

and the green unit further comprising a radio frequency video transmitter which can send signals to the radio frequency video receiver in the tee unit;

wherein the tee unit can receive video images from the tee camera of the golfer and the golf ball at the tee, and down the fairway towards the green, and the tee unit can also receive video images from the green camera of the golf ball when it has been hit onto the green, meaning that a video image from the tee camera and a video image from the green camera can both be provided at the tee;

wherein the golf shot recordal system further comprises one or both of: (a) a time delay system, such that image recording of the image from the green camera is started using said time delay system; and (b) a sensor to detect the instant at which the golf ball is struck and to trigger the image to start recording from that point; and wherein the recorded video images may be replayed, thereby allowing the golfer to be able to watch the golfer's shots after a round of golf has finished, wherein the tee unit is located at or near the tee, and the green unit is located in the golf hole on the green.

20. A method of recording video images of a golfer's shot, the method comprising:

providing a golf shot recordal system, said system comprising:

(a) a tee unit comprising a tee camera, the tee unit being locatable adjacent to a tee; and (b) a green unit comprising a green camera, the green unit being locatable proximate a golf hole on a green;

the green unit further comprising a pin that can be securely located in the golf hole on the green, with the green camera being mounted on the pin and with a central axis of a field of vision of the green camera being substantially directly in line with the pin;

the tee unit further comprising:

(i) a radio frequency video receiver which can receive and decode signals corresponding to the image from the green camera; and (ii) a video encoder that can receive signals corresponding to the tee images from the tee camera and that can receive signals corresponding to the green images from the radio frequency receiver;

the green unit further comprising a radio frequency video transmitter which can send signals to the radio frequency video receiver in the tee unit;

wherein the tee unit can receive video images from the tee camera of a golfer and a golf ball at the tee and down a fairway towards the green, and the tee unit can also receive video images from the green camera of the golf ball when it has been hit onto the green, meaning that a video image from the tee camera and a video image from the green camera can both be provided at the tee;

wherein the system comprises one or both of: (a) a time delay system, such that image recording of the image from the green camera is started using said time delay system; and (b) a sensor to detect the instant at which the golf ball is struck and to trigger the image to start recording from that point;

recording a video image of the golfer striking the golf ball on the tee using the tee camera, said video image being of the golfer and the golf ball at the tee and down the fairway towards the green such that a video image of the golfer and the golf ball at the tee is obtained; and recording a video image of the golf ball on the green using the green camera, said video image being of the golf ball when it has been hit onto the green such that a video image of the golf ball when it has been hit onto the green is obtained, wherein said recording of the image by the green camera is started using said time delay system or said sensor;

wherein said video image from the tee camera and said video image from the green camera are both provided at the tee, and wherein said recorded video images may be replayed, thereby allowing the golfer to be able to watch the golfer's shots after a round of golf has finished.

21. The system of claim 1, wherein the sensor to detect the instant at which the ball is struck and to trigger the start of the image recording from that point is an audio sensor.

22. The system of claim 21, wherein the audio sensor comprises a microphone and an audio processor.

23. The system of claim 1, wherein the time delay system is such that recording begins a set period of time after the ball has been struck, or a set period from activation of a system control unit in the green unit, or at whichever is the earlier of these two periods of time.

24. The system of claim 1, wherein the system includes both a time delay and a sensor system and the image recording is triggered by whichever of these occurs earlier.

25. The system of claim 1, wherein the green camera provides composite video output to the radio frequency video receiver and standard definition real-time video for inclusion in a composite picture-in-picture image produced by the video encoder of the tee unit.

* * * * *